United States Patent [19]

Rembges et al.

[11] 4,395,024

[45] Jul. 26, 1983

[54] APPARATUS FOR HARDENING METALLIC WORKPIECES INCLUDING FURNACE AND WORKPIECE TRANSPORT STRUCTURE, A PART OF WHICH CAN REMAIN IN THE FURNACE DURING FURNACE OPERATION

[75] Inventors: Wolfgang Rembges, Cologne; Jan G. Elwart, Erftstadt, both of Fed. Rep. of Germany

[73] Assignee: Klöckner Ionon GmbH, Leverkusen, Fed. Rep. of Germany

[21] Appl. No.: 338,058

[22] Filed: Jan. 8, 1982

[30] Foreign Application Priority Data

Jan. 17, 1981 [DE] Fed. Rep. of Germany ..... 3101351

[51] Int. Cl.[3] ..... C23C 11/10

[52] U.S. Cl. ..... 266/252; 148/16.6; 266/251

[58] Field of Search ..... 266/252, 274, 279, 250, 266/251; 148/16.6, 154, 16.5; 414/152, 172, 150, 158

[56] References Cited

U.S. PATENT DOCUMENTS

| | | | |
|---|---|---|---|
| 634,499 | 10/1899 | Hundley | 414/150 |
| 2,434,852 | 10/1946 | Jackson | 266/279 |
| 4,124,199 | 11/1978 | Jones et al. | 266/252 |
| 4,179,618 | 12/1979 | Tanaka et al. | 148/16.6 |
| 4,221,972 | 9/1980 | Oppel et al. | 266/252 |

FOREIGN PATENT DOCUMENTS

| | | | |
|---|---|---|---|
| 1435546 | 5/1976 | United Kingdom | 266/252 |

OTHER PUBLICATIONS

"*Ion Carburizing Furnace Energy Conservation–Antipollution Processing*", FIC Series Ulvac Corporation, technical pamphlet, Kennebunk Me.

*Primary Examiner*—L. Dewayne Rutledge
*Assistant Examiner*—Scott Kastler
*Attorney, Agent, or Firm*—Watson, Cole, Grindle & Watson

[57] ABSTRACT

An apparatus for the treatment of a metallic workpiece includes (a) a transport structure which includes a mounting portion and a platform portion, the platform portion, which is the part of the transport structure on which the workpiece to be treated is positioned, being electrically insulated from the mounting portion, and (b) a hollow furnace which includes heating elements and two spaced apart electrodes, the furnace being constructed to allow the platform portion of the transport structure to be located within the hollow furnace during its operation while the mounting portion remains exterior thereto.

17 Claims, 6 Drawing Figures

APPARATUS FOR HARDENING METALLIC WORKPIECES INCLUDING FURNACE AND WORKPIECE TRANSPORT STRUCTURE, A PART OF WHICH CAN REMAIN IN THE FURNACE DURING FURNACE OPERATION

BACKGROUND OF THE INVENTION

1. Field of the Invention

The present invention relates to apparatus for the treatment of metallic workpieces, and more particularly to apparatus used for the hardening of such metallic workpieces.

2. The Prior Art

It is known to subject metallic workpieces to various sequential treatments in order to harden them, such treatments including the subjecting of the workpieces to a glow treatment or ion-treatment (e.g., a plasma carburization), and to an oil bath treatment, and suitable apparatus for conducting such treatments are known. One known apparatus, made by the Ulvac company, includes a hollow furnace (located within a larger enclosed recipient which includes an entry and discharge station) which mounts a sealing door that can be opened to provide access to the treatment chamber therein, and which includes suitable heating elements and electrodes (the electrodes and their attached electrical lines being insulated from one another and from the other elements associated with the furnace), as well as evacuating and gas supply ducts, and a transport structure which can transport the metallic workpieces to be treated into the treatment chamber in the furnace, deposit the metallic workpieces on one of the electrodes, and then withdraw from the furnace, such that the door thereof can then be closed and the glow treatment (ion carburization, ion nitration, etc.) can be carried out. After such treatment the transport structure can be moved back into the furnace to pick up the still hot workpieces, and then transport them to other treatment stations, e.g., the oil bath treatment station.

With regard to the foregoing, the technology of ion carburization is well known and, for example, is discussed in detail in West German Patent No. 668,639. In order to ensure a stable glow discharge in a furnace, the two electrodes (anode and cathode) must be positioned so as to be electrically insulated from one another and all other components. Thus, as far as the prior art is aware, the transport structure used to transport the workpieces into the furnace must be removed prior to the operation of the furnace, and thus in the known prior art processes the transport structure leaves each workpiece, together with the plate on which it rests, in a charging pan in the furnace and then withdraws from the furnace prior to the actual operation of the furnace.

However, in order to achieve the necessary steps of transport of the workpiece to the furnace, deposit of the workpieces in the furnace, pick up of the workpieces after treatment and then removal of the treated workpieces from the furnace, the prior art transport structures have been very expensive, not only because they must include numerous independently movable elements, complex control systems and an overall regulator, but because they must be extremely durable so as to avoid the need for human assistance in their operation. Furthermore, operations using these transport structures are inefficient since such transport structures consume much time in accomplishing their deposit and pick up operations, and also a rapid quenching of the workpieces after the furnace has been opened can be only conditionally achieved.

It is thus an object of the present invention to overcome the drawbacks of the known hardening apparatus and to provide an apparatus for such purpose which is simple in construction and operation.

SUMMARY OF THE INVENTION

According to the present invention the treatment apparatus includes (a) a suitably constructed transport structure in which its platform portion, which is the portion on which the metallic workpiece to be treated is positioned, is electrically insulated from the remaining mounting portion, which is the portion which mounts the platform portion, and (b) a hollow furnace which is constructed to allow the platform portion of the noted transport structure to be located within the hollow furnace during treatment of the workpiece. The need for the portion of the transport structure which moves the workpieces into the furnace to include moving components and to execute complicated motions is completely eliminated.

According to one advantageous embodiment of the invention, the transport structure may be constructed similarly to a fork lift, with the platform portion which supports the workpiece formed as a grate, whereas the furnace may include a lifting mechanism that includes a pallet which is vertically movable within the treatment chamber in the furnace to lift the workpiece upwardly off the platform portion for treatment. In this embodiment the pallet, which is made of metal and which is electrically insulated from its supporting structure, will be electrically connected to a voltage source to thereby function as one of the electrodes in the furnace (preferably as a cathode). At the same time, the door attached to the furnace will include slots therein to allow the platform portion of the transport structure to be supported by the remainder of the transport structure which is located outside the hollow furnace.

In another advantageous embodiment of the invention, the aforementioned lifting mechanism is eliminated, whereas the furnace is provided in its interior with an arm electrode so positioned that it will contact the platform portion of the transport structure when the platform portion (which supports a metallic workpiece to be treated) is extended into the hollow furnace. In this inventive embodiment, the platform portion of the transport structure itself thus becomes one of the electrodes in the furnace. This platform portion of the transport structure is, as noted above, electrically insulated from the remainder of the transport structure and it is electrically insulated from all other elements associated with the furnace.

According to a third advantageous embodiment of the invention, the furnace includes elongated slots along its side walls and has elongated rails mounted outside of its side walls and below the elongated slots, and the transport structure includes as its platform portion a metallic plate-shaped floor and axles mounted thereunder, and as its mounting portion a number of wheel elements, each wheel element being associated with a separate axle end, and each wheel element including a rotatable wheel mounted on an elongated rail and an insulating sleeve connected to the wheel to extend through the elongated slot in the associated side wall of the hollow body. Each insulating sleeve acts to electrically insulate the associated axle end with both the associated wheel and side wall. Likewise to the second advantageous embodiment, the furnace may include an arm electrode therein which is positioned to contact the noted plate-shaped floor when appropriately positioned within the hollow furnace such that it becomes one of the electrodes in the furnace.

In any of the various embodiments of the invention the furnace may be provided with two access ducts, one of which is connected to a vacuum source and the other of which is connected to a source of gas, these ducts acting to provide the desired treatment atmosphere within the hollow furnace. This allows the furnace to operate more continuously and in better correspondence with the other treatement stations in the larger recipient in which the hollow furnace is operated.

A further understanding of the present invention will be achieved by reference to the accompanying drawings taken in conjunction with the following discussion.

DETAILED DESCRIPTION OF THE PREFERRED EMBODIMENTS

Figure 2:
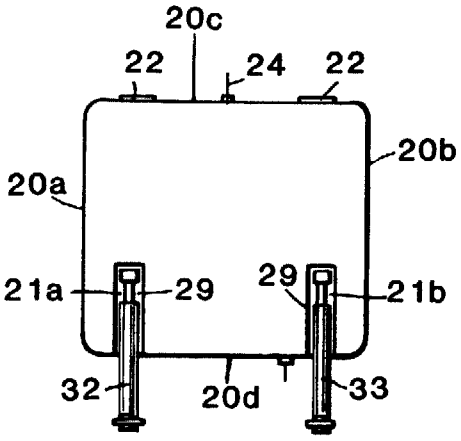
FIG. 2 shows a front elevational view of the furnace and associated workpiece transport structure as seen along line II—II in FIG. 1.
Figure 1:
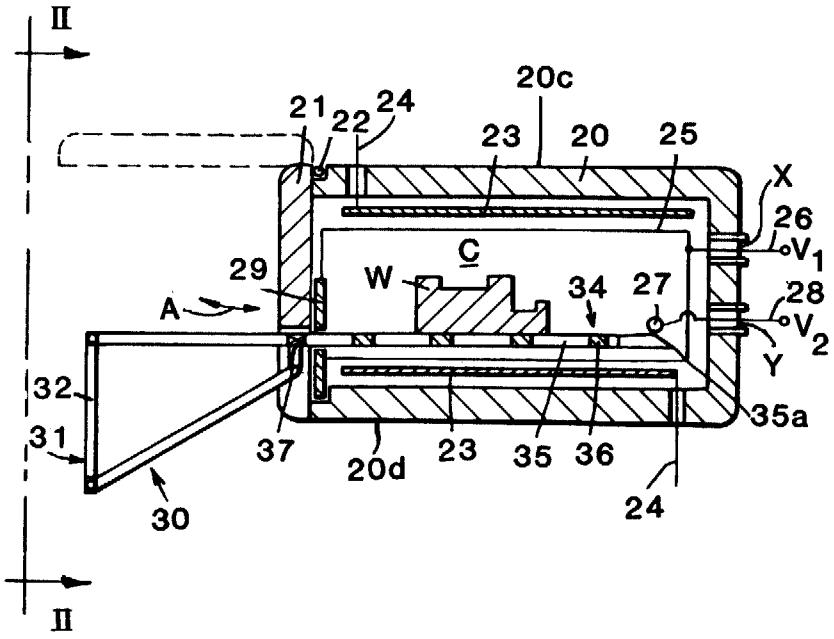
FIG. 1 shows a cross sectional view through the center of a furnace and associated workpiece transport structure constructed in accordance with one embodiment of the present invention.

One embodiment of the treatment apparatus according to the present invention is shown in FIGS. 1 and 2. It is seen to include a furnace 10 and a transport structure 30, the transport structure 30 being capable of moving a metallic workpiece W in and out of the furnace 10 and also supporting it while being treated in the furnace. The furnace 10 can, for example, operate as a treatment station for a workpiece being hardened, e.g., it can be an ion-treatment station. The various steps and required treatment stations for such hardening techniques are generally known.

The furnace 10 includes a body 20 formed by side walls 20*a*, 20*b*, bottom wall 20*c*, top wall 20*d* and end wall 20*e* (note that it has an open (front) end) and is hollow so as to provide a treatment chamber C therein. A door 21, which is connected by hinges 22 along its upper side to the top wall 20*d*, is pivotable to open or close the open end of the hollow body 20 as indicated by arrow A in FIG. 1. As best seen in FIG. 2, the door 21 also includes spaced apart openings 21*a* and 21*b* which extend upwardly from its lower side. The purpose of these openings will become apparent below.

Inside of the hollow body 20 are positioned upper and lower heating elements 23, a cup-shaped electrode 25 and an arm electrode 27. Each of the upper and lower heating elements 23 are connected to an electrical source by electrical lines 24 which respectively extend through suitable openings in the top wall 20*d* and the bottom wall 20*c* of the hollow body 20. The cup-shaped anode 25, which is in the form of a Faraday cage, is positioned between the heating elements 23 and has its open end facing the door 21. An electrical line 26, which at one end is connected to the cup-shaped anode 25 and passes through a first insulated opening X in the end wall 20*e* of hollow body 20, is connected at its other end to a voltage source $V_1$. The electrical line 26 is electrically insulated from all other elements associated with the furnace 10. The arm electrode 27, which is positioned to be within the cup-shaped anode 25 and near the end wall 20*e* of the hollow body 20, is constructed to be vertically movable (by support means, not shown) and to be biased in its lowermost position, either because of its own weight or because of the attachment of suitable springs thereto (not shown). An electrical line 28, which at one end is connected to the arm 27 and passes through a second insulated opening Y in the end wall 20*e* of the hollow body 20, is connected at its other end to a voltage source $V_2$. Similarly to electrical line 26, electrical line 28 is electrically insulated from all other elements associated with the furnace 10.

Also located inside of the hollow body 20 are insulating shrouds 29 which are positioned near the open end thereof to partially close off openings 21*a* and 21*b* in door 21 when the door 21 is closed over the open end of the hollow body. The shrouds are formed of a thermally insulating material and help prevent the escape of heat from the treatment chamber C to the outside. When the insulating materials of these shrouds 29 are covered by a metal shield, they will be appropriately connected to the ends of the cup-shaped anode 25.

Turning now to the transport structure 30, only a portion of which is shown in FIG. 1 (the non-depicted portion being well known), it is seen to include a mounting portion 31 and a platform portion 34, the two portions which are usually constructed of metallic materials, together appearing like a fork lift. The mounting portion 31 includes two spaced-apart, triangularly-shaped frame elements 32 and 33 (as seen in FIG. 2 these sections are spaced apart an equivalent distance to the spacing between openings 21*a* and 21*b* in door 21) and the platform portion 34 is formed of two parallel beam elements 35 and a number of parallel cross brace elements 36 connected therebetween. The platform portion 34 is thus in the form of a grate which supports a workpiece W. The platform portion 34 is attached to the mounting portion 31 by ceramic sleeves 37 which fit into openings (not shown) in the frame elements 32 and 33 and into which projections (not shown) from the beam elements 35 fit. The ceramic sleeves 37 act to electrically insulate the platform portion 34 from the mounting portion 31, yet will provide mechanical support for the projections fitting therein from beam elements 35 even if broken. They also act to thermally insulate the treatment chamber C from escape of heat through openings 21*a* and 21*b* of door 21 when the door 21 is closed and the furnace operated. The ceramic sleeves 37, as well as all other elements of the platform portion 34, are suitably sized to compensate for thermal expansions that result from exposure to the elevated temperatures generated within the furnace 10.

The end 35*a* of at least one beam element 35 that is opposite to the end connected to the associated frame elements 32 or 33 is downwardly sloped, such that as the transport structure 30 is moved towards the furnace 10 and the platform portion 34 becomes fully extended in the treatment chamber C, the sloped end 35*a* will contact the arm electrode 27 and act to move it upwardly. At the same time, because the arm electrode 27 is downwardly biased, it will maintain a good electrical contact with the associated beam element 35 and thus the platform portion 34 as a whole. Due to the electrical hookup of electrical line 28, the platform portion 34 will become an electrode (usually a cathode) that is completely electrically insulated from the mounting portion 31 of the transport structure 30 and all other elements of the furnace 10.

Figure 4:
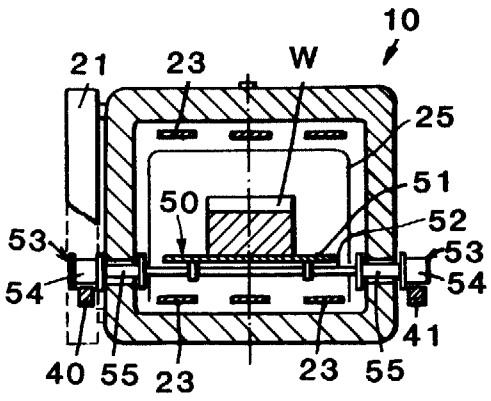
FIG. 4 shows a cross sectional view of the furnace and associated workpiece transport structure as shown in FIG. 3 and as seen along line IV—IV.
Figure 3:
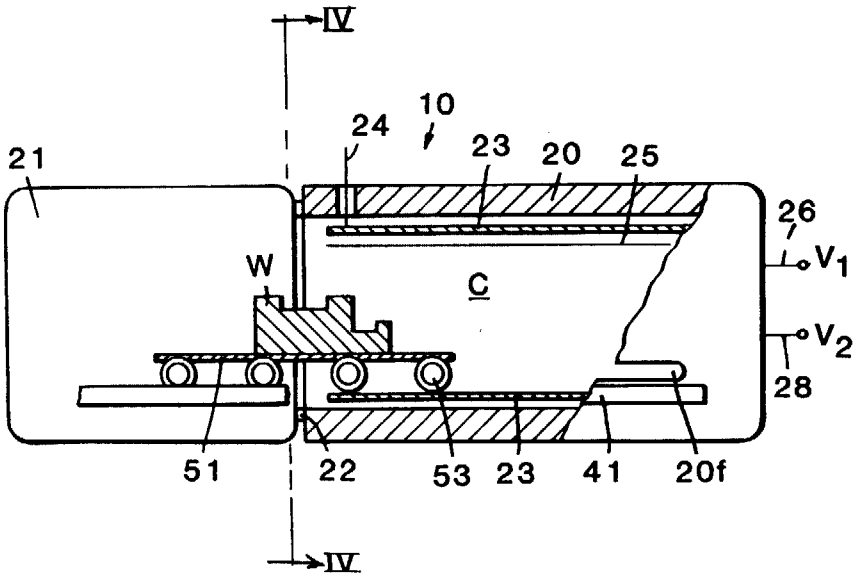
FIG. 3 shows a partially cut away side elevational view of a furnace and associated workpiece transport structure constructed in accordance with a second embodiment of the present invention.

Turning now to the embodiment of the invention shown in FIGS. 3 and 4, wherein like elements to those shown in FIGS. 1 and 2 are identified by like numerals, the door 21 is in this case seen to be attached along one of its sides to side wall 20*a* of the hollow body 20 so as to pivot horizontally to open or close the open end of hollow body 20. The hollow body 20 is also seen to include respective elongated slots 20*f* which extend horizontally along the opposite side walls 20*a*, 20*b* from the open end thereof towards the end wall 20*e*. In addition, separate stationary elongated rails 40 and 41 are positioned outside of the hollow body 20 and respectively below the elongated slots 20*f*, so as to run approximately parallel with the floor of the treatment chamber C.

Furthermore, the workpiece transport structure, instead of being constructed as a fork lift as shown in FIGS. 1 and 2, is instead constructed like a car. It includes a platform portion 50 and a mounting portion 53, the platform portion 50 including a metallic plate-shaped floor 51 and a number of axles 52 mounted therebeneath, the opposite ends of each axle 52 extending towards the opposite elongated slots 20*f*. The mounting portion 53 comprises a multiplicity of wheel elements which each include a rotatable wheel 54 and an electrically insulating sleeve 55 attached thereto, each wheel 54 being located outside the hollow body 20 and mounted on a respective elongated rail 40 or 41, and each insulating sleeve 55 extending through the elongated slot 20*f* in the associated side wall 20*a* or 20*b* and into the treatment chamber C. Each wheel element is associated with a different end of a different axle 52, such that the insulating sleeve of each wheel element surrounds a different axle end and insulates it from the associated side wall of the hollow body 20. The insulating sleeves 55 can not only provide elelctrical insulation between the axles 52 and both the hollow body 20 and the wheels 54, but they can also provide insulation against the escape of heat from within the treatment cavity C from slots 20*f*. Likewise to the situation in FIGS. 1 and 2, the plate-shaped floor 51, when fully inserted in the treatment chamber C, can contact an arm electrode similar to arm electrode 27 in FIG. 1 and thus become a cathode when the electrical line 28 is suitably connected to a voltage source $V_2$. The contact between the plate-shaped floor 51 and such an arm electrode can be assisted by providing an upwardly extending slope in the floor 20*d* of the hollow body which leads to a plateau portion beneath the arm electrode (not shown).

Figure 6:
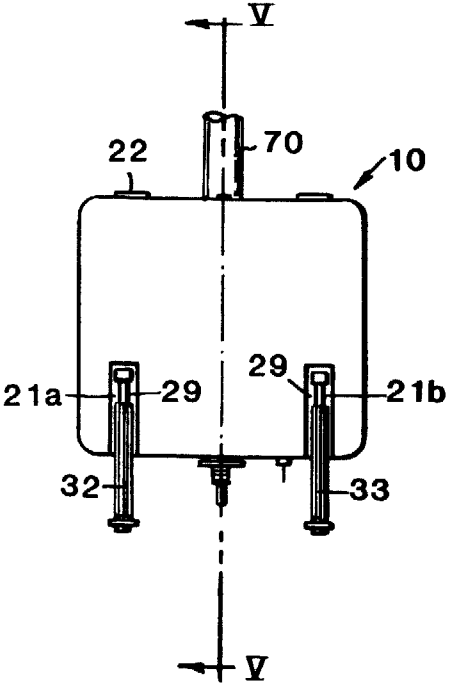
FIG. 6 shows a front elevational view of the furnace and associated workpiece transport structure of FIG. 5 and as seen along line VI—VI.
Figure 5:
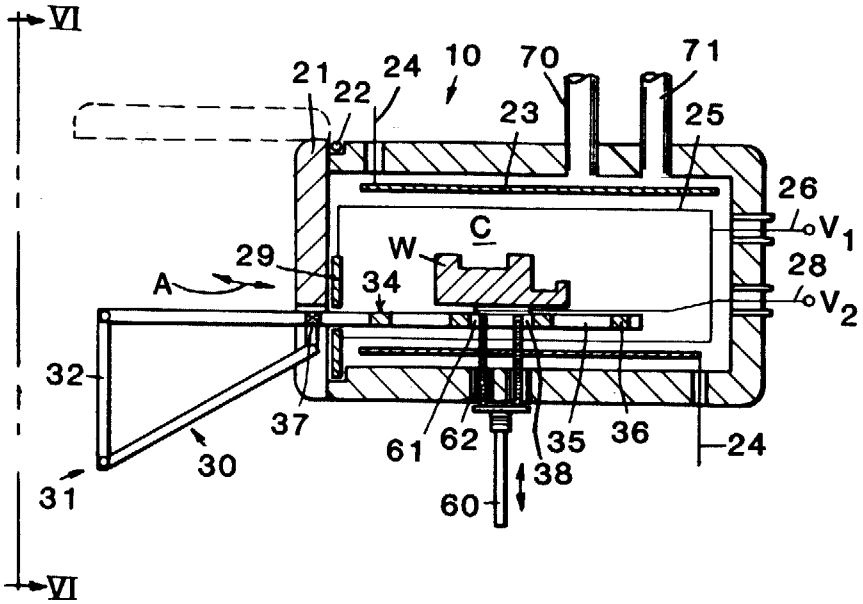
FIG. 5 shows a cross sectional view of a third embodiment of furnace and associated workpiece transport structure, the view being taken along line V—V of FIG. 6.

Referring finally to the embodiment of the invention depicted in FIGS. 5 and 6, wherein like elements to those shown in FIGS. 1 and 2 are identified by like numerals, the furnace 10 is seen to be provided with an additional lifting mechanism 60 which includes a metallic pallet 61 and supporting legs 62, the pallet 61 being located within the treatment chamber C between the upper and lower heating elements 23. The supporting legs 62 extend through openings in the bottom wall 20*d* of the body 20 (and between individual heating strips forming the lower heating element 23) to support the pallet 61. The pallet 61 is sized such that it will fit within (and be movable through) an opening 38 formed between adjacent beam elements 35 and cross bar elements 26 in the platform portion 34 of the transporting structure 30 to lift a workpiece W which has been suitably positioned on the platform portion 34 prior to its insertion into the treatment chamber C. The pallet 61, which is electrically insulated from the legs 62 thereunder, will temporarily become one of the electrodes in the furnace due to its contacting the end of electrical line 28 once it has passed upwardly past opening 38 in the platform portion 34, or else will permanently be such an electrode by fixedly connecting the electrical line 28 thereto and running it parallel to the legs 62.

The hollow body 20 is also provided with access ducts 70 and 71, access duct 70 being connectable to a vacuum-generating mechanism (not shown) so as to evacuate the treatment cavity within the body 20 when desired, and access duct 71 being connectable to a source of gas so as to enable the desired atmosphere to be provided within the treatment chamber C.

Various modifications in the invention will be apparent to those of skill in the art, yet still fall within the scope of the appended claims.

We claim:

1. An apparatus for the treatment of a workpiece which comprises:

a furnace, said furnace including a hollow body having an open end and defining a treatment chamber therein, a door pivotally connected to said hollow body to open or close the open end thereof, upper and lower heating means located within said treatment chamber, two electrodes located within said treatment chamber between said upper and lower heating means, one of said electrodes being in the form of a cup-shaped Faraday cage whose open end faces the open end of said hollow body, and two electrical lines, each of said electrical lines being attached at one of its ends to a respective electrode and then extending through an electrically insulated opening in said hollow body so as to be connected to a voltage source located outside of said hollow body, each said electrical line being electrically insulated from all other elements of the furnace, and a transport structure, said transport structure being movable with respect to said furnace and including a metallic mounting portion and a metallic platform portion, said platform portion being electrically insulated from said mounting portion, and said transport sturcture being constructed such that said mounting portion is located outside of said hollow body when said transport structure is moved with respect to said furnace such that said platform portion, which at least initially supports the metallic workpiece to be treated, is operatively positioned within said treatment chamber and the door of said furnace is pivoted to close the open end of said furnace.

2. The apparatus as defined in claim 1 wherein the platform portion of said transport structure includes two parallel beam elements and a number of parallel cross brace elements connected between said beam elements so as to form a grate structure.

3. The apparatus as defined in claim 1 wherein the mounting portion of said transport structure includes two spaced apart, triangularly-shaped frame elements.

4. The apparatus as defined in claim 2 wherein the insulating means positioned where the platform portion of said transport structure is connected to the mounting portion comprises ceramic sleeves.

5. The apparatus as defined in claim 4 wherein said ceramic sleeves are located in holes formed in said frame elements, and wherein the ends of said beam elements of the platform portion nearest the mounting portion include projections which respectively fit within separate ceramic sleeves.

6. The apparatus as defined in claim 5 wherein said door includes two spaced apart openings extending upwardly from the bottom thereof, and wherein the portions of said frame elements of the mounting portion of said transport structure and said beam elements of the platform portion of said platform structure which are adjacent said ceramic sleeves extend through the respective openings in said door when said platform portion is fully extended into said treatment chamber and said door is closed over the open end of said hollow body.

7. The apparatus as defined in claim 6 wherein shrouds are mounted in said hollow body, said shrouds being capable of covering a part of an associated opening in said door when said platform portion is fully extended into said treatment chamber and said door is closed over the open end of said hollow body.

8. The apparatus as defined in claim 7 wherein the second of said electrodes is in the form of an arm which is vertically movable and downwardly biased, and wherein said arm electrode is positioned within said treatment chamber such that it will contact the platform portion of said transport structure when said transport structure is extended into said treatment chamber.

9. The apparatus as defined in claim 8 wherein the end of at least one beam element of the platform portion of said transport structure opposite the end connected to the mounting portion is downwardly sloped for contact with said arm electrode.

10. The apparatus as defined in claim 7 wherein said furnace includes a lifting means, said lifting means including a metallic pallet located in said treatment chamber and a number of supporting legs which are connected to said pallet to vertically move it within said treatment chamber, said supporting legs extending through openings in the bottom wall of said hollow chamber, and said pallet comprising said second electrode.

11. The apparatus as defined in claim 10 wherein said pallet is sized to fit within and be movable through the openings formed between the beam elements and cross brace elements of the platform portion of said transport structure, and wherein said pallet is electrically insulated from the supporting legs positioned therebelow.

12. The apparatus as defined in claim 9 wherein the platform portion of said transport structure includes a metallic plate-shaped floor and a number of axles attached below said plate-shaped floor, the opposite ends of each axle extending towards the respective elongated slots in the side walls of said hollow chamber.

13. The apparatus as defined in claim 10 wherein said furnace includes two elongated rails located outside said hollow body, each elongated rail being positioned below an elongated slot in a respective side wall of said hollow body.

14. The apparatus as defined in claim 1 wherein a first duct is connected to said hollow body to communicate with said treatment chamber therein so as to evacuate said treatment chamber.

15. The apparatus as defined in claim 14 wherein a second duct is connected to said hollow body to communicate with said treatment chamber therein so as to provide a suitable gas thereto.

16. The apparatus as defined in claim 10 wherein the mounting portion of said transport structure includes a multiplicity of wheel elements, each wheel element including a rotatable wheel and an electrically-insulating sleeve attached thereto, a separate wheel element being associated with each end of a respective axle of the platform portion of the transport structure, the wheel of each wheel element being located outside said hollow body and movably supported on one of the elongated rails, each insulated sleeve extending through the elongated slot in the associated side wall of the hollow body and into the treatment chamber, and each insulated sleeve surrounding a respective axle end.

17. An apparatus for the treatment of a workpiece which comprises:

a furnace defining a treatment chamber therein, said furnace including a hollow body having opposite side walls, a rear wall and an open end opposite said rear wall, said side walls including elongated slots extending from the open end of said hollow body toward the rear wall, a door pivotally connected to said hollow body to open or close the open end thereof, upper and lower heating means located within said treatment chamber, two electrodes located within said treatment chamber between said upper and lower heating means, one of said electrodes being cup-shaped, the open end of which faces the open end of said hollow body, and two electrical lines, each of said electrical lines being attached at one of its ends to a respective electrode and then extending through an electrically insulated opening in said hollow body so as to be connected to a voltage source located outside of said hollow body, each said electrical line being electrically insulated from all other elements of the furnace, and a transport structure, said transport structure being movable with respect to said furnace and including a metallic mounting portion and a metallic platform portion, said platform portion being electrically insulated from said mounting portion, and said transport structure being constructed such that said mounting portion is located outside of said hollow body when said transport structure is moved with respect to said furnace such that said platform portion, which at least initially supports the metallic workpiece to be treated, is operatively positioned within said treatment chamber and the door of said furnace is pivoted to close the open end of said furnace and such that parts of said transport structure extend through the elongated slots in said opposite side walls of said hollow chamber.

* * * * *